US005268701A

United States Patent [19]

Smith

[11] Patent Number: 5,268,701

[45] Date of Patent: Dec. 7, 1993

[54] RADIO FREQUENCY ANTENNA

[75] Inventor: Keith C. Smith, Santa Barbara, Calif.

[73] Assignee: Raytheon Company, Lexington, Mass.

[21] Appl. No.: 15,323

[22] Filed: Feb. 9, 1993

Related U.S. Application Data

[63] Continuation of Ser. No. 855,952, Mar. 23, 1992, abandoned.

[51] Int. Cl.[5] ..... H01Q 13/10

[52] U.S. Cl. ..... 343/767; 343/770

[58] Field of Search ..... 343/767, 770, 771, 795, 343/797

[56] References Cited

U.S. PATENT DOCUMENTS

| | | | |
|---|---|---|---|
| 3,836,976 | 9/1974 | Monser et al. | 343/797 |
| 4,001,834 | 1/1977 | Smith | 343/754 |
| 4,853,704 | 8/1989 | Diaz et al. | 343/767 |
| 4,905,013 | 2/1990 | Reindel | 343/795 |
| 4,978,965 | 12/1990 | Möhuchy | 343/795 |
| 5,081,466 | 1/1992 | Bitter, Jr. | 343/767 |

FOREIGN PATENT DOCUMENTS

| | | | |
|---|---|---|---|
| 0128903 | 10/1980 | Japan | 343/770 |

*Primary Examiner*—Michael C. Wimer
*Assistant Examiner*—Tan Ho
*Attorney, Agent, or Firm*—William R. Clark; Richard M. Sharkansky

[57] ABSTRACT

An improved dual polarized antenna element for use in planar array antennas. The antenna element includes a conductive sheet having a forwardly positioned notch and a pair of spaced rearwardly extending slot portions formed therein. The notch is adapted for coupling radio frequency energy between free space and the antenna element and the pair of slot portions are electrically coupled to the notch. A power divider/combiner is provided and is preferably interconnected with a power combiner/divider through branches of equal phase length. With this arrangement, reactive power divider induced off-axis scan blindness caused by an odd mode coupled field is prevented. Additionally, an antenna module comprising a pair of such antenna elements disposed in intersecting relationship is provided with a coincident phase center.

15 Claims, 4 Drawing Sheets

RADIO FREQUENCY ANTENNA

This invention was made with Government support under Contract No. F09603-84-G-3254-0011 awarded by the U.S. Department of the Air Force. The Government has certain rights in this invention.

This application is a continuation of application Ser. No. 07/855,952, filed Mar. 23, 1992, now abandoned.

BACKGROUND OF THE INVENTION

This invention relates generally to radio antennas and more particularly to antennas adapted to transmit and/or receive radio frequency energy with any one of a variety of polarizations.

As is known in the art, it is often desirable to use an antenna element which can operate with any one of a variety of polarizations, such as linear (i.e. vertical or horizontal) or circular. Often, an array of such antenna elements is used in order to provide a collimated and angularly directed beam of radiation and to attain a relatively wide scan angle (i.e. narrow beam). The angular direction of such beam is related to the phase angle distribution provided by a phase shifting network across the array. Thus, on either transmit or receive, radiation is fed to or received by the array with a phase distribution in accordance with a desired angular direction.

One such antenna arrangement is described in U.S. Pat. No. 3,836,976 entitled "Closely Spaced Orthogonal Dipole Array," with inventors George J. Monser, George S. Hardie, John R. Ehrhardt, and Jerry M. Smith, issued Sep. 17, 1974 and assigned to the assignee of the present invention. More particularly, an array of antenna modules is described, with each module including a pair of planar antenna elements. The pair of planar antenna elements intersects along a common line of intersection with the antenna elements being disposed orthogonally with respect to one another. Each planar antenna element of a module is fed by a separate radio frequency energy feed. For circular polarization, each of the feeds of the module is fed with radio frequency energy having a quadrature phase difference.

More particularly, each planar antenna element has a flared notch, symmetrically disposed with respect to the line of intersection. A forward portion of the flared notch is disposed along a forward edge of the planar antenna element, adjacent free space, so that radio frequency energy is coupled between the antenna element and free space therethrough. A rearward portion of the notch terminates in a relatively narrow slot which in turn is coupled to a coaxial transmission line. While the slot is disposed along the line of intersection, the coaxial line is displaced therefrom so that the pair of planar antenna elements can physically intersect. More particularly, the outer conductor of the coaxial line is connected to one side of the slot while the center conductor of the coaxial line crosses the line of intersection to span the slot for connection to the other side of the slot. Thus, on transmit, radio frequency energy fed to the coaxial transmission line produces an electric field across the slot; whereas on receive, radio frequency energy received by the notch produces an electric field across the slot for coupling to the center conductor of the coaxial transmission line.

However, because the center conductors of each of the pair of antenna elements of a module must be electrically isolated, they cannot occupy the same space and, thus, are displaced one from the other as they cross the common line of intersection to span their corresponding slots. Hence, the phase center (i.e. the point which, from the far field, appears as the source of RF energy) of each of the pair of planar antenna elements are at different locations, resulting in non-coincident phase centers. More specifically, the only way to realize coincident phase centers is through manipulation of the radio frequency energy fed to each of the orthogonal elements. Coincident phase centers are desirable so that an antenna module appears as a point source of radiation from the far field. While the above-described antenna may be useful in some applications, in other applications a higher degree of phase coincidence may be desirable without the use of energy feed manipulation.

In another type of antenna arrangement adapted to transmit and receive radio frequency energy with a variety of polarizations, each antenna module again includes a pair of orthogonal planar antenna elements, but with each such element having a pair of flared notches spaced by a predetermined distance along the forward edge of the antenna element. More particularly, a forward portion of each of the pair of flared notches of each antenna element is disposed along the forward edge of such element, adjacent free space. Each one of such notches again has a rearward portion terminating in a relatively narrow slot. Here however, each of the pair of flared notches of an element is positioned symmetrically, on opposite sides of the line of intersection.

More particularly, a single radio frequency feed is coupled to an input/output port of a power divider/combiner. Each one of a pair of output/input ports thereof is coupled to a different one of the pair of narrow slots and such slots ar disposed on opposite sides of the line of intersection. Thus, with a pair of intersecting planar antenna elements, there will be four spaced feed points for the four narrow slots. However, because of the symmetrical positioning of the pair of notches and narrow slots about the line of intersection, each pair of notches appears in the far field as emanating from a single point. Thus, from the far field, each element has the appearance of having a single phase center disposed on the line of intersection. Furthermore, with two intersecting planar antenna elements, there remains the appearance of a coincident phase center on the line of intersection. Moreover, such antenna elements are provided with coincident phase centers without manipulation of the radio frequency energy fed thereto.

However, it has been found that when arrays of such antenna modules are used, adjacent elements or modules may interact with one another because of cross-coupling effects. More particularly, energy transmitted by an antenna element may couple into an adjacent element and cause resonating in the adjacent element. Specifically, this problem occurs when the wavefront of the radiation is at an angular direction, other than normal, to the array. In such case, when the energy received by each of the pair of flared notches of the adjacent antenna element is out of phase, such energy does not fully combine in the power divider/combiner and such uncombined energy resonates in the element. Moreover, such resonating energy, often referred to as odd mode resonance, is undesirable since it may cause narrow band dropouts or scan blindness at the resonating frequency.

One technique known in the art for reducing the aforementioned resonating condition is to use a power divider/combiner which includes energy dissipating resistors to damp out the odd mode resonance (i.e. absorb the resonant energy). However, this technique may be costly due to the complexity associated with fabricating such a power divider/combiner, as well as the concomitant reduced production yield. Moreover, use of this technique limits the power handling capability of the power divider/combiner in accordance with the power handling capability of the damping resistors. Furthermore, the use of energy dissipating resistors reduces the overall efficiency of the antenna for certain operating conditions.

SUMMARY OF THE INVENTION

With the foregoing background in mind, it is an object of the present invention to provide an improved antenna element.

A further object is to provide such an improved antenna module capable of transmitting and receiving radio frequency energy with one of a variety of polarizations.

Another object is to provide an array antenna having a reduced occurrence odd mode resonance.

A still further object is to provide a method for reducing the odd mode resonating in an antenna element caused by energy radiated from an adjacent element.

These and other objects are attained generally by providing an antenna element comprising a conductive sheet having formed therein a forwardly positioned notch for coupling radio frequency energy between free space and the antenna element and a pair of spaced, rearwardly extending slot portions. The slot portions are electrically coupled to the notch. Also provided is a radio frequency feed comprising a pair of spaced feed branches, with each one thereof having a first end coupled to a port of the radio frequency feed and a second end coupled to a corresponding one of the pair of slot portions. A power divider/combiner is provided having an input/output port coupled to the port of the radio frequency feed and a pair of output/input ports. Each one of the pair of output/input ports is coupled to a corresponding one of the pair of feed branches. The preferred antenna element further includes a bifurcated slot comprising the pair of rearwardly extending slot portions and a main slot portion disposed at the rear of the notch. The preferred antenna element further comprises a power combiner/divider having an output/input port coupled to the main slot portion and a pair of input/output ports, with each one thereof being coupled to a corresponding one of the pair of rearwardly extending slot portions.

With this arrangement, the use of a single notch on the antenna element eliminates the resonating condition heretofore associated with the use of a pair of notches. This is achieved by eliminating independent paths for energy to couple into each of the feed branches of the radio frequency feed. In other words, energy coupled into the pair of feed branches of the antenna element from an adjacent element is so coupled through the single notch, and preferably through the power combiner/divider. Thus, the energy in each of the feed branches is of equal magnitude and phase and will be completely combined at the power combiner/divider.

In accordance with a further aspect of the invention, pairs of such antenna elements are positioned in an orthogonal, intersecting arrangement to provide a radio frequency antenna module. More particularly, first and second antenna elements have first and second lines of intersection, respectively, extending from a forward edge to a rearward edge thereof and intersecting the corresponding notch. Furthermore, each of the pair of rearwardly extending slot portions of the first and second antenna elements is disposed on an opposite side of the respective line of intersection. The first and second antenna elements are disposed to intersect at their respective lines of intersection.

With this arrangement, an improved radio frequency antenna module capable of transmitting and receiving radio frequency energy with one of a variety of polarizations is provided. Moreover, such antenna module does not experience odd mode resonance caused by radiation coupled from adjacent modules, such as when a plurality of antenna modules are disposed in a linear array. This is because radio frequency energy is not independently coupled into each of the slot portions of each of the antenna elements; rather, the energy thus coupled is in phase and of equal magnitude. In other words, here such energy is coupled to each of the pair of slot portions of an antenna element through a single or common notch and preferably through a power combiner/divider so that such energy is of equal magnitude and phase. An additional benefit of this antenna module is that the orthogonally disposed first and second antenna elements are arranged so as to readily provide coincident phase centers.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENTS

Figure 1:
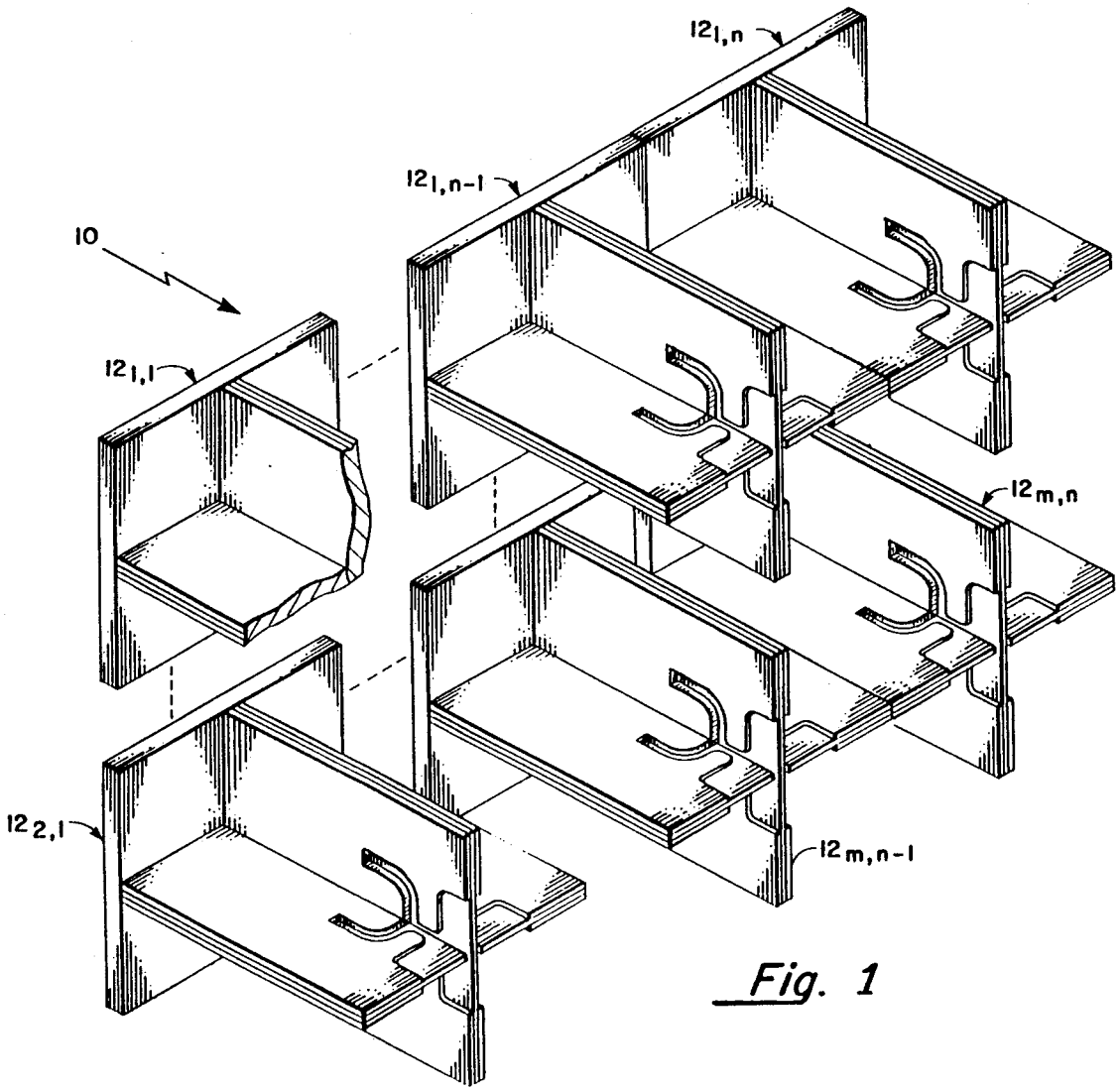
FIG. 1 is an isometric view of an array antenna in accordance with the present invention.
Figure 2:
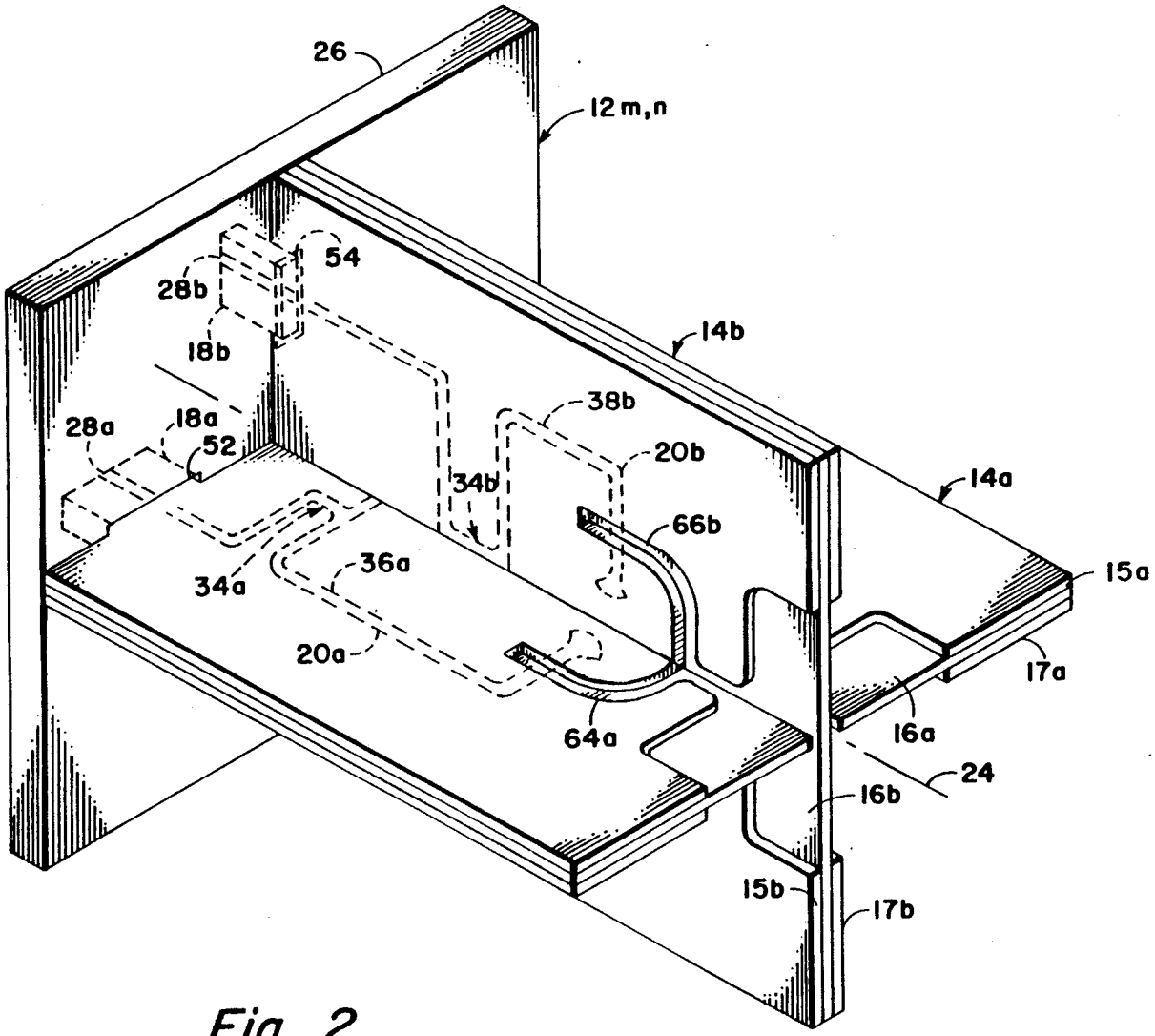
FIG. 2 is an isometric view of an exemplary one of the antenna modules comprising the array antenna of FIG. 1.

Referring now to FIG. 1, an antenna 10 is shown to include a plurality of antenna modules $\mathbf{12}_{l,l}$ to $\mathbf{12}_{m,n}$ arranged in a linear array, and thus hereinafter being referred to as an array antenna 10. An exemplary one $\mathbf{12}_{m,n}$ of the antenna modules $\mathbf{12}_{l,l}$ to $\mathbf{12}_{m,n}$ is shown in greater detail in FIGS. 2 and 3, in which antenna module $\mathbf{12}_{m,n}$ is shown to include a first planar antenna element 14*a* and a second planar antenna element 14*b*, with the second antenna element 14*b* being disposed to intersect with the first antenna element 14*a* along a common line of intersection 24 (FIG. 2). More specifically, antenna element 14*a* has a line of intersection 24*a* (FIG. 3) extending from a forward edge to a rearward edge thereof. Similarly, antenna element 14*b* has a line of intersection 24*b* (FIG. 3) extending from a forward edge to a rearward edge thereof. In assembly, lines of intersection 24*a* and 24*b* overlap at the common line of intersection 24. Each of the antenna elements 14*a*, 14*b* includes a conductive sheet 15*a*, 15*b* having formed therein a flared notch 16*a*, 16*b*, respectively, and a pair of spaced, rearwardly extending slot portions 64*a*, 66*a* and 66*b*, 66*b*, respectively. Note that here, each antenna element 14a, 14b includes two such conductive sheets 15a, 17a and 15b, 17b, respectively, as will be described below. The slot portions 64a, 66a and 64b, 66b of antenna elements 14a, 14b, respectively, are electrically coupled to the corresponding notch 16a, 16b, respectively. Moreover, the slot portions 64a, 66a and 64b, 66b of each element 14a, 14b, respectively, are disposed symmetrically (i.e. on opposite or a different side thereof) with respect to the respective lines of intersection 24a, 24b. Here, notches 16a, 16b are also disposed symmetrically with respect to respective lines of intersection 24a, 24b.

The first antenna element 14a includes a first radio frequency feed 20a comprising a pair of spaced feed branches 36a, 38a with a first end of each of such feed branches 36a, 38a being coupled to (i.e. terminating at) a port 28a of element 14a and a second end of branches 36a, 38a being coupled to a corresponding one of slot portions 64a, 66a, respectively. Like the slot portions 64a, 66a, each of the pair of feed branches 36a, 38a is disposed on a different, or opposite side of the line of intersection 24a, as shown in FIG. 3.

The second antenna element 14b similarly includes a second radio frequency feed 20b comprising a pair of spaced feed branches 36b, 38b with a first end of each of such branches 36b, 38b being coupled to a port 28b of element 14b and a second end of branches 36b, 38b being coupled to a corresponding one of slot portions 64b, 66b, respectively. Here again, each of the pair of feed branches 36b, 38b is disposed on a different, or opposite side of the line of intersection 24b, as shown in FIG. 3.

Antenna module $12_{m,n}$ is further shown to include a back panel 26 disposed perpendicular to the first and second antenna elements 14a, 14b. Back panel 26 is, here, comprised of a planar substrate of dielectric material with a conducting material, such as copper, disposed thereover by any conventional method to provide a ground plane for antenna elements 14a, 14b. Here, back panel 26 has a height and width of 0.5 inches. Referring briefly back to FIG. 1, when a plurality of antenna modules $12_{l,l}$ to $12_{m,n}$ are arranged in a linear array to form array antenna 10, the back panels of adjacent such modules $12_{l,l}$ to $12_{m,n}$ may be soldered or otherwise electrically coupled together to provide a continuous ground plane for the array antenna 10. Other conventional methods of mounting the plurality of antenna modules $12_{l,l}$ to $12_{m,n}$ to provide an array may alternatively be used.

Figure 3:
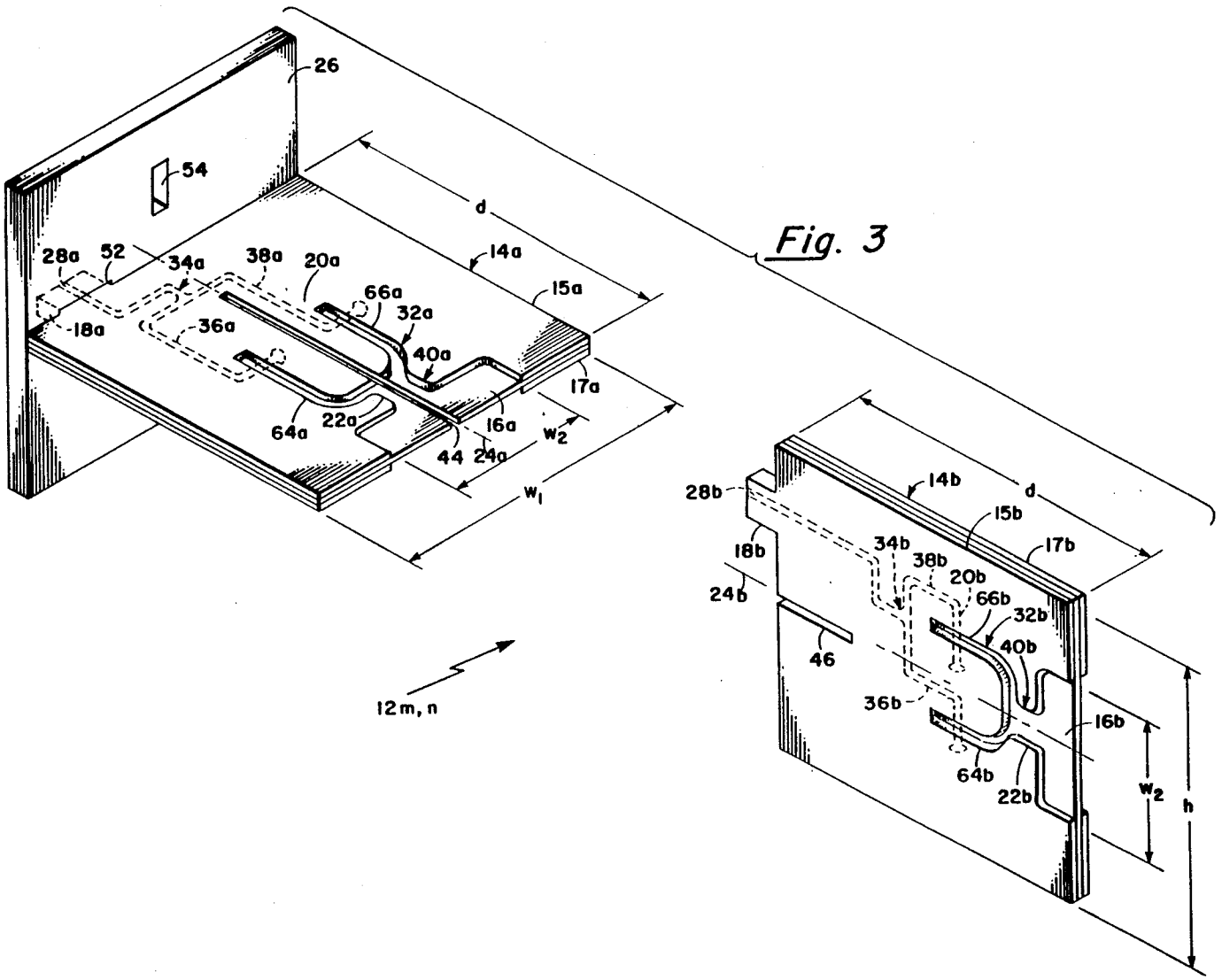
FIG. 3 is an exploded isometric view of the antenna module of FIG. 2.

Referring now specifically to FIG. 3, the depth (d) of each of antenna elements 14a, 14b is, here, 1.5 inches. The width ($w_1$) of antenna element $14_a$ is equal to the height (h) of antenna element 14b, and here is 0.5 inches. The width ($w_2$) of the flared notches 16a, 16b is approximately one-half of the width ($w_1$) of antenna element 14a or the height (h) of antenna element 14b. Here, each of flared notches 16a, 16b is thus 0.25 inches wide. More specifically, notches 16a, 16b have a relatively wide portion disposed along the forward edge of the elements 14a, 14b respectively, adjacent free space (such opening having the width $w_2$) and terminate rearwardly into a narrow or main slot portion, 22a, 22b, respectively as shown.

The radio frequency feeds 20a, 20b of antenna elements 14a, 14b, respectively, will be described in greater detail below in conjunction with FIG. 4. Suffice it here to say however that each of the antenna elements 14a, 14b has a tab 18a, 18b, respectively, extending from a rear edge thereof, on which ports 28a, 28b of the respective feeds 20a, 20b are disposed. Feed 20a includes a reactive power divider/combiner 34a. Port 28a of feed 20a is coupled to an input/output port of power divider/combiner 34a, two output/input ports of which are coupled to different ones of feed branches 36a, 38a, as shown. Antenna element 14a further includes a bifurcated slot 32a, here including the pair of spaced, rearwardly extending slot portions 64a, 66a and main slot portion 22a, with the main slot portion 22a being disposed between notch 16a and the pair of slot portions 64a, 66a so that notch 16a terminates rearwardly into main slot portion 22a. Preferably, the first antenna element further comprises a power combiner/divider 40a having an output/input port coupled to the main slot portion 22a and a pair of input/output ports. Each one of the pair of input/output ports is coupled to a corresponding one of the slot portions 64a, 66a, respectively.

Radio frequency feed 20b of antenna element 14b is similar to feed 20a in that it includes a power divider/combiner 34b and feed branches 36b, 38b. Port 28b of feed 20b is coupled to an input/output port of power divider/combiner 34b and a pair of output/input ports thereof are coupled to different ones of feed branches 36b, 38b. The second antenna element 14b further includes a bifurcated slot 32b comprising the pair of spaced, rearwardly extending branch slot portions 64b, 66b and main slot portion 22b. The main slot portion 22b is disposed between notch 16b and slot portions 64b, 66b such that notch 16b terminates rearwardly into the main slot portion 22b. Branches 36b, 38b of radio frequency 20b are coupled to a corresponding one of the slot portions 64b, 66b, respectively. Preferably, the second antenna element 14b further comprises a power combiner/divider 40b having an output/input port coupled to the main slot portion 22b and a pair of input/output ports. Each one of the pair of input/output ports is coupled to a corresponding one of the slot portions 64b, 66b, respectively.

The dual functionality of power divider/combiners 34a, 34b and power combiner/dividers 40a, 40b will become apparent from the following discussion of the operation of antenna module $12_{m,n}$. Module $12_{m,n}$ couples radio frequency energy between an array antenna 10 and free space, as is conventional. More particularly, module $12_{m,n}$ both transmits and receives radio frequency energy. Consider, for example, the operation of antenna element 14a when radio frequency energy is transmitted; noting however that like operation simultaneously occurs in antenna element 14b. When such energy is transmitted, port 28a of feed 20a is coupled to, or fed by, a conventional source of radio frequency energy. Such energy is subsequently divided, here by 2:1 reactive power divider/combiner 34a for coupling to feed branches 36a, 38a of radio frequency feed 20a. Thus, like energy, or energy of equal power and phase, is coupled through each feed branch 36a, 38a. The energy is further coupled to the corresponding one of slot portions 64a, 66a, here by a stripline to slotline transition, as will be described below in conjunction with FIG. 4. The energy is subsequently recombined by, here a 1:2 reactive power combiner/divider 40a for further coupling to flared notch 16a. Such energy is then radiated from flared notch 16a into free space. Note that the electrical length of each branch 36a, 38a is the same and that of each slot portion 64a, 66a is the same. With this arrangement, the energy coupled by power divider/combiner 34a through feed branch 36a and slot portion 64a is fully combined by power divider/combiner 40a with that coupled through feed branch 38a and slot portion 66a.

When radio frequency energy is received by antenna module $12_{m,n}$, the functionality of power divider/combiners 34a, 34b and power combiner/dividers 40a, 40b is reversed. Consider for simplicity, the operation of antenna element 14a when radio frequency energy is received; noting again that like operation simultaneously occurs in antenna element 14b. Radio frequency energy from free space is coupled through flared notch 16a and is divided by power combiner/divider 40a. Such divided energy (i.e. energy of equal power and phase) is coupled through slot portion 64a and feed branch 36a as well as through slot portion 66a and feed branch 38a, and is re-combined by power divider/combiner 34a for further coupling to feed port 28a.

From the above, it is apparent that because of the dual functionality of antenna elements 14a, 14b, that divider/combiners 34a, 34b operate as dividers when radio frequency energy is being transmitted and as combiners when such energy is received. It is similarly apparent that combiner/dividers 40a, 40b operate as power combiners when radio frequency energy is being transmitted and as power dividers when such energy is received.

Consider next the assembly of antenna module $12_{m,n}$, shown in FIG. 3 prior to assembly and in FIG. 2 after assembly. As mentioned above, planar antenna elements 14a and 14b are disposed with their respective planes intersecting one another. Preferably, antenna elements 14a, 14b are disposed orthogonal to one another to provide module $12_{m,n}$, as shown. Moreover, here it is along the lines of intersection 24a, 24b of each of the elements 14a, 14b, respectively, that such elements 14a, 14b intersect. Antenna element 14a has a slot 44 (FIG. 3) originating at the forward edge thereof, distal from back panel 26, and extending along the line of intersection 24a substantially through the depth (d) of antenna element 14a. Antenna element 14b has a complimentary slot 46 (FIG. 3) disposed therein, here such slot 46 originating at the rear edge of antenna element 14b, proximal to back panel 26, and extending along the line of intersection 24b thereof a relatively short distance through the depth (d) of antenna element 14b. More particularly, slots 44 and 46 are complimentary in the sense that their combined lengths equal the depth (d) of antenna elements 14a, 14b. This arrangement of slots 44 and 46 provides that, in assembly, the forward edges of antenna elements 14a, 14b are flush, as shown in FIG. 2. Additionally, back panel 26 has a pair of apertures 52 and 54 disposed therethrough, as shown. Apertures 52 and 54 are slightly larger in size than tabs 18a and 18b, respectively.

In assembly, antenna element 14a is disposed perpendicular to back panel 26 with tab 18a inserted into aperture 52, as shown. Slots 44 and 46 of antenna elements 14a, 14b respectively are aligned as shown in FIG. 3, here, with such elements 14a, 14b being disposed orthogonally with respect to one another. In such alignment, antenna element 14b is moved toward back panel 26 and over antenna element 14a to insert tab 18b into aperture 54, thereby forming the antenna module $12_{m,n}$ of FIG. 2. Elements 14a, 14b are then electrically coupled to back panel 26 in any conventional manner, such as by soldering. It should be apparent that the assembly of module $12_{m,n}$ may alternatively be achieved in other manners, such as by aligning antenna elements 14a, 14b so that their forward edges (along which flared notches 16a, 16b are disposed) are flush and then moving such elements 14a, 14b into alignment with back panel 26.

With module $12_{m,n}$ thus assembled, tabs 18a, 18b of antenna elements 14a, 14b, respectively, protrude from the rear side of back panel 26, as is conventional. This arrangement facilitates connections to ports 28a, 28b of radio frequency feeds 20a, 20b, respectively. For example, in the array antenna 10 (FIG. 1), connectors may be fastened to tabs 18a, 18b of antenna elements 14a, 14b, respectively, and to like tabs (not shown) of the other ones of the pairs of antenna elements comprising the other ones $12_{l,l}$–$12_{l,n}$ and $12_{m,l}$–$12_{m,n-1}$ of modules $12_{l,l}$ to $12_{m,n}$. Such connectors may then be further coupled to a radio frequency feed network, such as one comprising phase shifters, as is conventional.

With the above described antenna module $12_{m,n}$, radio frequency energy with any one of a variety of polarizations can be transmitted and/or received. For example, circular polarization is attained when the radio frequency energy or signals coupled to feeds 20a and 20b have a ninety degree phase difference (i.e. a quadrature phase difference).

The antenna module $12_{m,n}$ here provided and capable of transmitting and/or receiving radio frequency energy in any one of a variety of polarizations is desirable since such arrangement readily provides a coincident phase center. It is desirable that the orthogonal antenna elements 14a, 14b have coincident phase centers so that antenna module $12_{m,n}$ can be characterized as a "point source" of radio frequency energy as it appears from the far field. The coincident phase center is here achieved generally by providing each of the orthogonal antenna elements 14a, 14b, with electrically identical and symmetrically disposed feed arrangements. With the arrangement herein described, and in particular with the symmetry of the feeds 20a, 20b and bifurcated slots 32a, 32b, about the respective lines of intersection 24a, 24b, antenna elements 14a, 14b are provided with coincident phase centers. Considering antenna element 14a for example, because feed branches 36a, 38a and slot portions 64a, 66a are disposed symmetrically with respect to the line of intersection 24a and the combination of feed branch 36a and corresponding slot portion 64a is electrically identical to the that of feed branch 38b and corresponding slot portion 66a, the element 14a appears from the far field as a point source of radiation disposed on the line of intersection 24a. Similarly, the symmetrical positioning and the electrical equivalence of feed branch 36b and corresponding slot portion 64b as well as that of feed branch 38b and corresponding slot portion 66b, provides the phase center of antenna element 14b along the line of intersection 24b. Thus, as the phase centers of each of the orthogonal antenna elements 14a, 14b is disposed along the common line of intersection, 24 (FIG. 3), so too is the phase center for the entire module $12_{m,n}$.

Another benefit of the above-described antenna module $12_{m,n}$ is that a resonating condition, heretofore occurring in antenna elements including a pair of flared notches, with each notch being fed by a different branch of a bifurcated feed member, is eliminated. More particularly, and as described above, such resonating condition occurs when a plurality of such antenna elements are disposed in an array and each of the pair of notches of an element receives out of phase, or odd mode, radio frequency energy from an adjacent element. Specifically, resonating occurs as a result of such received, out of phase energy, being coupled through the feed branches, and not being fully combined by the power divider/combiner. The present arrangement eliminates such resonating condition by providing only one single, or common flared notch 16a, 16b on each of the orthogonal antenna elements 14a, 14b, respectively. In other words, radio frequency energy cannot independently couple into the feed branches 36a, 38a or 36b, 38b of each of the antenna elements 14a, 14b, respectively. Rather, considering for example antenna element 14a, energy coupled into the flared notch 16a is divided by power combiner/divider 40a and thus the energy coupled to feed branches 36a, 38a via corresponding slot portions 64a, 66a, respectively, is of equal power and phase. Since the feed paths of branch 36a and slot portion 64a as well as that of branch 38a and slot portion 66a are electrically identical, such energy will be completely re-combined by power divider/combiner 34a. Thus, there will be no resonance in the feed branches 36a, 38a and slot portions 64a, 66a.

Figure 4:
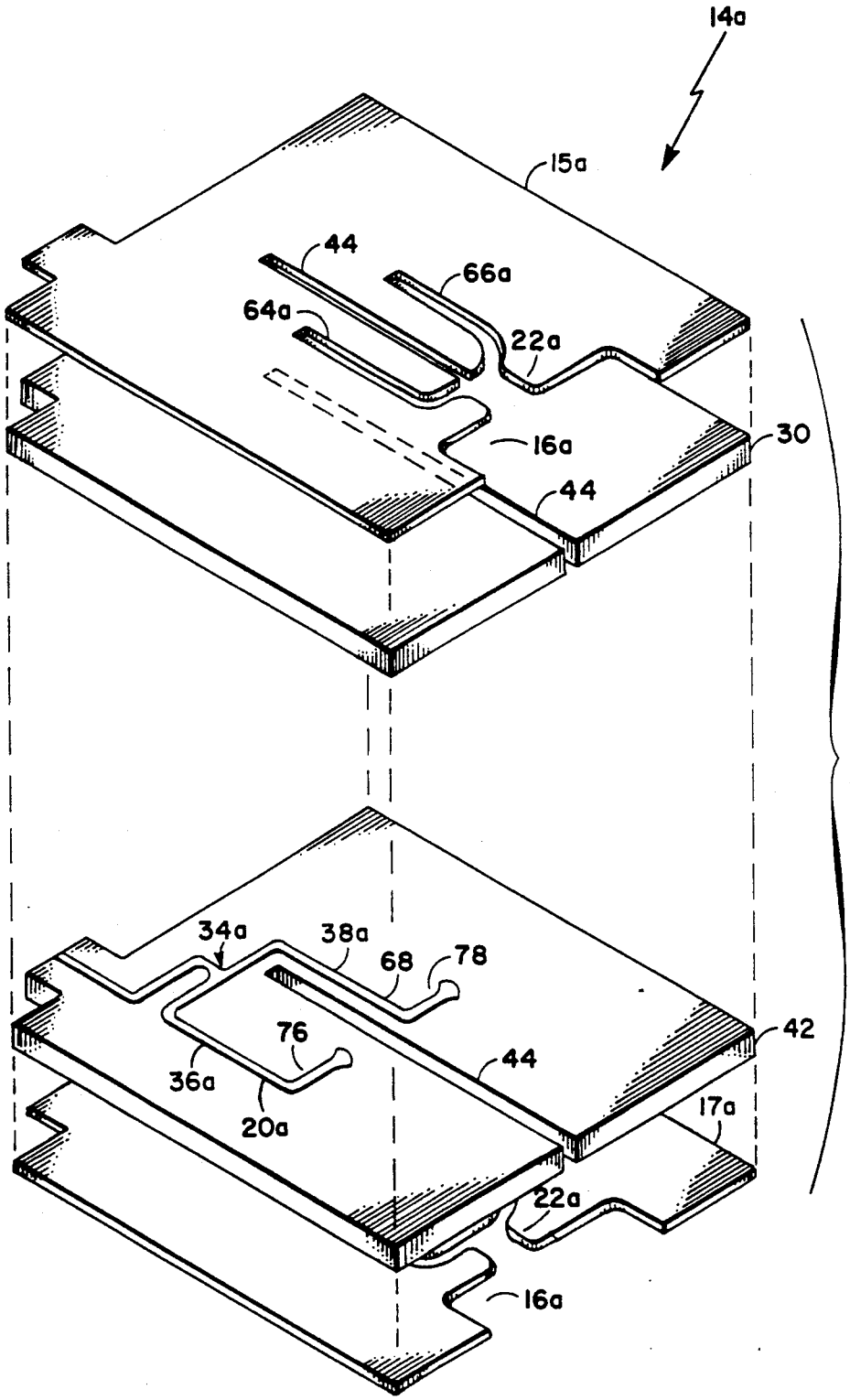
FIG. 4 is an exploded isometric view of one of an exemplary one of the antenna elements of the module of FIG. 3.

Referring now to FIG. 4, the layered construction of antenna elements 14a, 14b is shown with reference to the construction of antenna element 14a which is exemplary of the construction of element 14b. Note however that the construction of antenna elements 14a, 14b differs in the slots 44, 46 formed therein, respectively. Specifically, slot 44 of element 14a differs from slot 46 of element 14b in length and in the edge of the respective element 14a from which it extends. Additional differences in the construction of elements 14a, 14b, and specifically in feeds 20a, 20b, will be described below. Antenna element 14a is shown to include a pair of dielectric and here Teflon, support structures 30 and 42 having a dielectric constant of 2.2. The thickness of support structures 30 and 42 is here, approximately 0.03 inches. Support structures 30, 42 have like slots 44 disposed therein, as shown.

Dielectric support structure 30 has a layer 15a of conductive material disposed on the upper surface thereof and a similar layer (not shown) disposed on the lower surface thereof, here comprised of copper. The conductive layer on the lower surface of support structure 30 is removed entirely with a suitable chemical etchant. Layer 15a is etched using conventional photolithographic chemical etching techniques to provide flared notch 16a. More specifically, layer 15a is etched to form flared notch 16a, main slot portion 22a, and rearwardly extending slot portions, or slotline circuit portions 64a, 66a. Also etched into conductive layer 15a is slot 44, as shown.

Support structure 42 similarly has copper layers 68, 17a clad onto upper and lower surfaces thereof respectively. Like conductive layer 15a, the conductive layer 17a disposed on the lower surface of support structure 42 has a flared notch 16a, a main slot portion 22a, and branch slot portions, or slotline circuit portions, 64a, 66a etched therein using conventional photolithographic chemical etching techniques. The conductive layer 68 clad onto the upper surface of support structure 42 is selectively etched to provide radio frequency feed 20a (FIGS. 2 and 3), here providing a stripline circuit. Note however that feed 20a may alternatively be a coaxial or a slotline transmission line. Each of feed branches 36a and 38a has a transition end portion 76, 78, respectively, coupled thereto as will be described. Here, the feed 20a is comprised of copper with a thickness of approximately 0.0015 inches. Referring briefly to FIG. 3, it is noted that feed 20b differs from feed 20a in, inter alia, the length of the feed branches 36b, 38b. More specifically, here feed branches 36a, 38a of feed 20a are longer than feed branches 36b, 38b of feed 20b. This length difference is due to the length of the slots 44, 46. Specifically, feed branches 36a, 38a are longer than branches 36b, 38b so that they can be routed along opposite sides of slot 44 without intersecting such slot 44. However, feeds 20a and 20b are electrically identical since the difference in the length of feed branches 36a, 38a and 36b, 38b is compensated by the length of the stripline feed between the ports 28a, 28b and power divider/combiners 34a, 34b, respectively, as shown.

In assembly, support structures 30, 42 and the conductive layers 15a, 68, and 17a clad thereto, as described above, are in vertical alignment to form antenna element 14a. More specifically, in assembly, notches 16a, main slot portions 22a, and slot portions 64a, 66a of each of conductive layers 15a and 17a are in vertical alignment. Also slots 44 formed in conductive layers 15a, 17a and support structures 30, 42 are vertically aligned. Moreover, in assembly, transition end portions 76, 78 of feed 20a cross over the corresponding of slot portions 64a, 66a, respectively, as shown in FIGS. 2 and 3. The transition end portions 76, 78 are designed to match the impedance of the slot portions 64a, 66a to that of feed 20a, here such impedance being approximately 73 ohms. As is conventional, conductive layers 15a, 17a are electrically coupled to conductive back panel 26 in assembly of module $12_{m,n}$ (FIG. 2)

Having described preferred embodiments of the invention, it will now become apparent to one of skill in the art that other embodiments incorporating their concepts may be used. It is felt, therefore, that these embodiments should not be limited to disclosed embodiments, but rather should be limited by the spirit and scope of the appended claims.

What is claimed is:

1. An antenna element comprising:

a conductive sheet having formed therein a forwardly positioned notch adapted for coupling radio frequency energy between free space and the antenna element and a pair of spaced, rearwardly extending slot portions, each of said slot portions having opposing sides, each of said sides being formed by said conductive sheet, said slot portions being electrically coupled to said notch.

2. The antenna element recited in claim 1 further comprising:

a radio frequency feed comprising a pair of spaced feed branches, with each one of said pair of feed branches having a first end coupled to a port of said radio frequency feed and a second end coupled to a corresponding one of said slot portions.

3. An antenna element comprising:

a conductive sheet having formed therein a forwardly positioned notch adapted for coupling radio frequency energy between free space and the antenna element and a pair of spaced, rearwardly extending slot portions electrically coupled to said notch;

a radio frequency feed comprising a pair of spaced feed branches, with each one of said pair of feed branches having a first end coupled to a port of said radio frequency feed and a second end coupled to a corresponding one of said slot portions;

said radio frequency feed further comprising a power divider/combiner having an input/output port coupled to said port of said radio frequency feed and a pair of output/input ports, with each one of said pair of output/input ports being coupled to a corresponding one of said pair of feed branches.

4. The antenna element recited in claim 3 wherein said antenna element further comprises a bifurcated slot comprising said pair of slot portions and a main slot portion disposed at the rear of said notch, and said antenna element further comprising a power combiner/divider having an output/input port coupled to said main slot portion and a pair of input/output ports, with each one of said pair of input/output ports being coupled to a corresponding one of said pair of slot portions.

5. The antenna element recited in claim 4 wherein said radio frequency feed comprises a stripline transmission line.

6. The antenna element recited in claim 4 wherein said radio frequency feed comprises a coaxial transmission line.

7. The antenna element recited in claim 4 wherein said bifurcated slot comprises a slotline circuit.

8. The antenna element recited in claim 4 wherein said radio frequency feed comprises a microstrip transmission line.

9. A radio frequency antenna module comprising:

a first planar antenna element having a first line of intersection extending from a forward edge to a rearward edge thereof, said antenna element comprising a conductive sheet having formed therein a notch and a pair of spaced, rearwardly extending slot portions, each of said slot portions having opposing sides, each of said sides being formed by said conductive sheet said slot portions being electrically coupled to said notch, said notch being disposed along said forward edge of said first antenna element and being intersected by said first line of intersection, wherein each one of said pair of slot portions is disposed on an opposite side of said first line of intersection; and a second planar antenna element having a second line of intersection extending from a forward edge to a rearward edge thereof, said antenna element comprising a conductive sheet having formed therein a notch and a pair of spaced, rearwardly extending slot portions, each of said slot portions having opposing sides, each of said sides being formed by said conductive sheet said slot portions being electrically coupled to said notch, said notch being disposed along said forward edge of said second antenna element and being intersected by said second line of intersection, wherein each one of said pair of slot portions is disposed on an opposite side of said second line of intersection; and wherein said first antenna element and said second antenna element are disposed to intersect at the first line of intersection and said second line of intersection.

10. The radio frequency antenna module recited in claim 9 further comprising a back panel disposed perpendicular to said first and second antenna elements.

11. The radio frequency antenna module recited in claim 9 wherein said first line of intersection bisects said notch of said first antenna element and said second line of intersection bisects said notch of said second antenna element.

12. The radio frequency antenna module recited in claim 9 wherein the first and second antenna elements are disposed orthogonal to one another.

13. A radio frequency antenna module comprising:

a first planar antenna element having a first line of intersection extending from a forward edge to a rearward edge thereof, said antenna element comprising a conductive sheet having formed therein a notch and a pair of spaced, rearwardly extending slot portions electrically coupled to said notch, said notch being disposed along said forward edge of said first antenna element and being intersected by said first line of intersection, wherein each one of said pair of slot portions is disposed on an opposite side of said first line of intersection;

a second planar antenna element having a second line of intersection extending from a forward edge to a rearward edge thereof, said antenna element comprising a conductive sheet having formed therein a notch and a pair of spaced, rearwardly extending slot portions electrically coupled to said notch, said notch being disposed along said forward edge of said second antenna element and being intersected by said second line of intersection, wherein each one of said pair of slot portions is disposed on an opposite side of said second line of intersection;

said first antenna element and said second antenna element being disposed to intersect at the first line of intersection and said second line of intersection; and said first antenna element further comprising a radio frequency feed comprising a pair of spaced feed branches, with a first end of each of said pair of feed branches being coupled to a port of said radio frequency feed of said first antenna element and a second end of each of said pair of feed branches being coupled to a corresponding one of said pair of slot portions of said first antenna element and wherein said second antenna element further comprises a radio frequency feed comprising a pair of spaced feed branches with a first end of each of said pair of feed branches being coupled to a port of said second radio frequency feed of said second antenna element and a second end of each of said pair of feed branches being coupled to a corresponding one of said pair of slot portions of said second antenna element.

14. The radio frequency antenna module recited in claim 13 wherein said first antenna element further comprises a power divider/combiner having an input/output port coupled to said port of said radio frequency feed of said first antenna element and a pair of output/input ports, each one of said output/input ports being coupled to a corresponding one of said pair of feed branches of the radio frequency feed of said first antenna element and wherein aid second antenna element further comprises a power divider/combiner having an input/output port coupled to said port of said radio frequency feed of said second antenna element and a pair of output/input ports, each one of said output/input ports being coupled to a corresponding one of the pair of feed branches of the radio frequency feed of said second antenna element.

15. The radio frequency antenna module recited in claim 14 wherein said first antenna element further comprises a power combiner/divider having an output/input port coupled to said first antenna element notch and a pair of input/output ports each one of said pair of input/output ports being coupled to a corresponding one of the pair of slot portions of the first antenna element and wherein said second antenna element further comprises a power combiner/divider having an output/input port coupled to said second antenna element notch and a pair of input/output ports, each one of said pair of input/output ports being coupled to a corresponding one of the pair of slot portions of the second antenna element.

* * * * *